US009633769B2

(12) United States Patent
Takata et al.

(10) Patent No.: US 9,633,769 B2
(45) Date of Patent: Apr. 25, 2017

(54) MAGNETIC REFRIGERATION MATERIAL

(75) Inventors: Hiroaki Takata, Kobe (JP); Toshio Irie, Kobe (JP)

(73) Assignee: SANTOKU CORPORATION, Hyogo (JP)

( * ) Notice: Subject to any disclaimer, the term of this patent is extended or adjusted under 35 U.S.C. 154(b) by 645 days.

(21) Appl. No.: 14/005,081

(22) PCT Filed: Mar. 14, 2012

(86) PCT No.: PCT/JP2012/056507
§ 371 (c)(1),
(2), (4) Date: Sep. 13, 2013

(87) PCT Pub. No.: WO2012/124721
PCT Pub. Date: Sep. 20, 2012

(65) Prior Publication Data

US 2014/0007593 A1 Jan. 9, 2014

(30) Foreign Application Priority Data

Mar. 16, 2011 (JP) ..... 2011-084036

(51) Int. Cl.

| | |
|---|---|
| ***F25B 21/00*** | (2006.01) |
| ***H01F 1/01*** | (2006.01) |
| ***C22C 38/00*** | (2006.01) |
| ***C22C 38/02*** | (2006.01) |
| ***C22C 38/10*** | (2006.01) |
| ***C22C 38/06*** | (2006.01) |
| ***C22C 38/14*** | (2006.01) |
| ***C22C 38/18*** | (2006.01) |
| ***C21D 1/74*** | (2006.01) |
| ***C22C 1/02*** | (2006.01) |
| *C22C 33/02* | (2006.01) |

(52) U.S. Cl.

CPC ..... *H01F 1/015* (2013.01); *C21D 1/74* (2013.01); *C22C 1/02* (2013.01); *C22C 38/002* (2013.01); *C22C 38/005* (2013.01); *C22C 38/02* (2013.01); *C22C 38/06* (2013.01); *C22C 38/10* (2013.01); *C22C 38/14* (2013.01); *C22C 38/18* (2013.01); *F25B 21/00* (2013.01); *C22C 33/0278* (2013.01); *C22C 2202/02* (2013.01); *F25B 2321/002* (2013.01)

(58) Field of Classification Search

CPC ..... F25B 21/00; H01F 1/012; H01F 1/015; C22C 38/10; C22C 38/06; C22C 38/02; C22C 38/005; C22C 38/30; C22C 38/14; C22C 38/002

USPC ..... 62/3.1; 420/83

See application file for complete search history.

(56) References Cited

U.S. PATENT DOCUMENTS

| | | | | |
|---|---|---|---|---|
| 7,563,330 | B2 | 7/2009 | Tsuji et al. | |
| 7,914,628 | B2 | 3/2011 | Tsuji et al. | |
| 2004/0079446 | A1* | 4/2004 | Kogure ..... | H01F 1/015 148/101 |
| 2006/0213580 | A1 | 9/2006 | Tsuji et al. | |
| 2007/0137732 | A1 | 6/2007 | Kogure et al. | |
| 2009/0071572 | A1 | 3/2009 | Fujita et al. | |

FOREIGN PATENT DOCUMENTS

| | | | |
|---|---|---|---|
| CN | 1065294 | A | 10/1992 |
| CN | 1837393 | A | 9/2006 |
| CN | 101477864 | A | 7/2009 |
| CN | 101567240 | A | 10/2009 |
| GB | 2 424 901 | A | 10/2006 |
| JP | 2004-100043 | A | 4/2004 |
| JP | 2005-200749 | A | 7/2005 |
| JP | 2006-89839 | A | 4/2006 |
| JP | 2006-274345 | A | 10/2006 |
| JP | 2006-307332 | A | 11/2006 |
| JP | 2006-316324 | A | 11/2006 |
| JP | 2009-221494 | A | 10/2009 |

OTHER PUBLICATIONS (Tishin, A.M., and Y.I. Spichkin. "Application of Magnetocaloric Effect." The Magneto caloric Effect and Its Applications. Bristol: Institute of Physics Pub., 2003. 406).*

Tishin, A.M., and Y.I. Spichkin. "Application of Magnetocaloric Effect." The Magnetocaloric Effect and Its Applications. Bristol: Institute of Physics Pub., 2003. 406.*

Wang Guang-Jun et al: "Effects of Fe-Fe bond length change in NaZnI3-type intermetallic compounds on magnetic properties and magnetic entropy change," Chinese Physics, Institute of Physics Publishing, Bristol, GB, vol. 13, No. 4, Apr. 1, 2004, pp. 546-551.

Deng J et al: "Effect of gallium doping on the magneto caloric effect of LaFe11.2Co0.7Si1.1," Rare Metals—Xiyou Jinshu, Press of Metallurgical Industry, Beijing, CN, vol. 27, No. 4, Aug. 1, 2008, pp. 345-349.

European Patent Office, Communication dated Oct. 7, 2014, issued in corresponding European application No. 12756965.5.

(Continued)

*Primary Examiner* — Jessee Roe
*Assistant Examiner* — Anthony Liang
(74) *Attorney, Agent, or Firm* — Sughrue Mion, PLLC

(57) ABSTRACT

Provided is a magnetic refrigeration material which has a Curie temperature near room temperature or higher, and provides refrigeration performance well over that of conventional materials when subjected to a field change up to 2 Tesla, which is assumed to be achievable with a permanent magnet. The magnetic refrigeration material is of a composition represented by the formula $La_{1-f}RE_f(Fe_{1-a-b-c-d-e}Si_aCO_bX_cY_dZ_e)_{13}$ (RE: at least one of rare earth elements including Sc and Y and excluding La; X: Ga and/or Al; Y: at least one of Ge, Sn, B, and C; Z: at least one of Ti, V, Cr, Mn, Ni, Cu, Zn, and Zr; $0.03 \le a \le 0.17$, $0.003 \le b \le 0.06$, $0.02 \le c \le 0.10$, $0 \le d \le 0.04$, $0 \le e \le 0.04$, $0 \le f \le 0.50$), and has Tc of not lower than 220 K and not higher than 276 K, and the maximum ($-\Delta S_{max}$) of magnetic entropy change ($-\Delta S_M$) of the material when subjected to a field change up to 2 Tesla is not less than 5 J/kgK.

10 Claims, No Drawings

(56) References Cited

OTHER PUBLICATIONS

International Searching Authority, International Preliminary Report on Patentability issued in corresponding International application No. PCT/JP2012/056507, dated Sep. 17, 2013.
A. Takahashi-Saito, et al., "Magnetic Refrigeration near Room Temperature", Magune, 2006, pp. 308-315, vol. 1, No. 7.
Jun Shen, et al., "Magnetic properties and magnetic entropy changes of $LaFe_{11.0}Co_{0.8}(Si_{1-x}Al_x)_{1.2}$ compounds", Journal of Magnetism and Magnetic Materials, 2007, pp. 2823-2825, vol. 310, No. 2.
E.C. Passamani, et al., "Magnetic and magnetocaloric properties of $La(Fe,Co)_{11.4}SP_{1.6}$ compounds (SP=A1 or Si)", Journal of Magnetism and Magnetic Materials, 2007, pp. 65-71, vol. 312, No. 1.

* cited by examiner

MAGNETIC REFRIGERATION MATERIAL

CROSS REFERENCE TO RELATED APPLICATIONS

This application is a National Stage of International Application No. PCT/JP2012/056507, filed on Mar. 14, 2012, which claims priority from Japanese Patent Application No. 2011-084036, filed on Mar. 16, 2010, the contents of all of which are incorporated herein by reference in their entirety.

FIELD OF ART

The present invention relates to a magnetic refrigeration material that is suitably used in household electric appliances, such as freezers and refrigerators, and air conditioners for vehicles, as well as to a magnetic refrigeration device.

BACKGROUND ART

There has recently been proposed a magnetic refrigeration system as a substitute for a conventional gaseous refrigeration system using fluorocarbon gas as a cooling medium, which gas induces environmental problems including global warming.

The magnetic refrigeration system employs a magnetic refrigeration material as a refrigerant, and utilizes magnetic entropy change occurred when the magnetic order of the magnetic material is changed by magnetic field under isothermal conditions, and adiabatic temperature change occurred when the magnetic order of the magnetic material is changed by magnetic field under adiabatic conditions. Thus, freezing by the magnetic refrigeration system eliminates the use of fluorocarbon gas, and improves refrigeration efficiency compared to the conventional gaseous refrigeration system.

As a magnetic refrigeration material used in the magnetic refrigeration system, Gd (gadolinium)-containing materials are known, such as Gd and/or Gd compounds. The Gd-containing materials are known to have a wide operating temperature range, but exhibit a disadvantageously small magnetic entropy change ($-\Delta S_M$). Gd is a rare and valuable metal even among rare earth elements, and cannot be said to be an industrially practical material.

Then, $NaZn_{13}$-type $La(FeSi)_{13}$ compounds are proposed as having a larger magnetic entropy change ($-\Delta S_M$) than the Gd-containing materials. For further improvement in performance, for example, Non-patent Publication 1 discusses various substitution elements, including cobalt (Co) substitution, and Patent Publication 1 proposes partial substitution of La with Ce and hydrogen adsorption to give $La_{1-z}Ce_z(Fe_xSi_{1-x})_{13}H_y$ and increase the Curie temperature. Patent Publication 2 proposes adjustment of a Co—Fe—Si ratio in $La(Fe_{1-x-y}Co_ySi_x)_{13}$ to expand the operating temperature range.

Further, as means for producing these materials, for example, Patent Publication 3 proposes solidification by rapid cooling on a roll, Patent Publication 4 proposes resistance-sintering under pressurizing, and Patent Publication 5 proposes reaction of Fe—Si alloy with La oxide.

Patent Publication 1: JP-2006-089839-A
Patent Publication 2: JP-2009-221494-A
Patent Publication 3: JP-2005-200749-A
Patent Publication 4: JP-2006-316324-A
Patent Publication 5: JP-2006-274345-A Non-patent Publication 1: "*Jiki Reito Gijutsu no Jo-on-iki heno Tenkai* (Magnetic Refrigeration near Room Temperature)", Magune, Vol. 1, No. 7 (2006)

SUMMARY OF THE INVENTION

The LaFeSi materials reported in Non-patent Publication 1 and Patent Publication 1 have increased Curie temperature while the maximum ($-\Delta S_{max}$) of the magnetic entropy change ($-\Delta S_M$) is maintained, but the operating temperature range of these magnetic refrigeration materials is narrower than the Gd-containing materials, so that a plurality of kinds of materials with different operating temperature ranges are required for constituting a magnetic refrigeration system, causing difficulties in handling. Further, the LaFeSi materials generally have a Curie temperature of about 200 K, and accordingly cannot be used as it is as a magnetic refrigeration material intended for room temperature range.

Patent Publication 2 submits relative cooling power (abbreviated as RCP hereinbelow) as an index to magnetic refrigeration performance. On the basis of this index, the magnetic refrigeration materials disclose in these publications either have a large maximum ($-\Delta S_{max}$) of the magnetic entropy change ($-\Delta S_M$) with a narrow operating temperature range, or a wide operating temperature range with a small maximum ($-\Delta S_{max}$) of the magnetic entropy change ($-\Delta S_M$), so that the RCP of these materials are comparable to that of the Gd-containing materials. Thus, these magnetic refrigeration materials can hardly be said to provide drastically improved performance.

The present invention has been made focusing attention on these problems of the prior art. Research has been made on the effects of each substitution element mentioned in the prior art to be given on the properties, and the composition of the elements has been adjusted, to thereby solve the above problems.

It is an object of the present invention to provide a magnetic refrigeration material which has a Curie temperature near room temperature or higher, and provides refrigeration performance well over the prior art refrigeration performance when subjected to a change in magnetic field up to about 2 Tesla, which is assumed to be achievable with a permanent magnet.

It is another object of the present invention to provide a magnetic refrigeration material which has not only a large magnetic entropy change ($-\Delta S_M$), but also a wide operating temperature range, in other words, has large RCP.

According to the present invention, there is provided a magnetic refrigeration material of a composition represented by the formula $La_{1-f}RE_f(Fe_{1-a-b-c-d-e}Si_aCo_bX_cY_dZ_e)_{13}$, wherein RE stands for at least one element selected from the group consisting of rare earth elements including Sc and Y and excluding La, X stands for at least one of Ga and Al, Y stands for at least one element selected from the group consisting of Ge, Sn, B, and C, Z stands for at least one element selected from the group consisting of Ti, V, Cr, Mn, Ni, Cu, Zn, and Zr, a satisfies $0.03 \le a \le 0.17$, b satisfies $0.003 \le b \le 0.06$, c satisfies $0.02 \le c \le 0.10$, d satisfies $0 \le d \le 0.04$, e satisfies $0 \le e \le 0.04$, and f satisfies $0 \le f \le 0.50$, wherein said magnetic refrigeration material has a Curie temperature of not lower than 220 K and not higher than 276 K, and a maximum ($-\Delta S_{max}$) of magnetic entropy change ($-\Delta S_M$) of said material when subjected to a field change up to 2 Tesla is not less than 5 J/kgK.

According to the present invention, there is provided a magnetic refrigeration device and a magnetic refrigeration system, both employing the magnetic refrigeration material.

According to the present invention, there is also provided use of an alloy of a composition represented by the above formula in the manufacture of a magnetic refrigeration material having a Curie temperature of not lower than 220 K and not higher than 276 K, and a maximum ($-\Delta S_{max}$) of magnetic entropy change ($-\Delta S_M$) of said material when subjected to a field change up to 2 Tesla of not less than 5 J/kgK.

The magnetic refrigeration material of the present invention has a Curie temperature near room temperature or higher, and not only the magnetic entropy change ($-\Delta S_M$) of the material is large, but also the operating temperature range of the material is wide, so that a magnetic refrigeration material with refrigeration performance well over that of the conventional materials may be provided. Further, with the use of the magnetic refrigeration material of the present invention, less kinds of materials are required than conventionally were for constituting a magnetic refrigeration system. Selection of magnetic refrigeration materials with different Curie temperatures will enable construction of magnetic refrigeration devices adapted to different applications, such as a home air-conditioner and an industrial refrigerator-freezer.

PREFERRED EMBODIMENTS OF THE INVENTION

The present invention will now be explained in detail.

The magnetic refrigeration material according to the present invention employs an alloy of the composition represented by the formula $La_{1-f}RE_f(Fe_{1-a-b-c-d-e}Si_aCo_bX_cY_dZ_e)_{13}$.

In the formula, RE stands for at least one element selected from the group consisting of rare earth elements including Sc and Y (yttrium) and excluding La, X stands for at least one of Ga and Al, Y stands for at least one element selected from the group consisting of Ge, Sn, B, and C, Z stands for at least one element selected from the group consisting of Ti, V, Cr, Mn, Ni, Cu, Zn, and Zr, a satisfies $0.03 \le a \le 0.17$, b satisfies $0.003 \le b \le 0.06$, c satisfies $0.02 \le c \le 0.10$, d satisfies $0 \le d \le 0.04$, e satisfies $0 \le e \le 0.04$, and f satisfies $0 \le f \le 0.50$.

In the magnetic refrigeration material according to the present invention, part of La in the alloy may be substituted with RE. Represented by f is the content of element RE partially substituting La, and is $0 \le f \le 0.50$. La and element RE are capable of controlling the Curie temperature, the operating temperature range, and also the RCP. When f is above 0.50, the magnetic entropy change ($-\Delta S_M$) is small.

Represented by a is the content of the element Si, and is $0.03 \le a \le 0.17$. Si is capable of controlling the Curie temperature, the operating temperature range, and also the RCP. Si also has the effects of adjusting the melting point of the compound, increasing the mechanical strength, and the like. When a is below 0.03, the Curie temperature is low, whereas when a is above 0.17, the magnetic entropy change ($-\Delta S_M$) is small.

Represented by b is the content of the element Co, and is $0.003 \le b \le 0.06$. Co is effective in controlling the Curie temperature and the magnetic entropy change ($-\Delta S_M$). When b is below 0.003, the magnetic entropy change ($-\Delta S_M$) is small, whereas when b is above 0.06, the full width at half maximum of the curve of the magnetic entropy change ($-\Delta S_M$) as a function of temperature under 0-2 Tesla is narrow.

Represented by c is the content of element X, and is $0.02 \le c \le 0.10$. X is effective in controlling the operating temperature range. When c is below 0.02, the full width at half maximum of the curve of the magnetic entropy change ($-\Delta S_M$) as a function of temperature under 0-2 Tesla is narrow, whereas when c is above 0.10, the magnetic entropy change ($-\Delta S_M$) is small.

Represented by d is the content of element Y, and is $0 \le d \le 0.04$. Y is capable of controlling the Curie temperature, the operating temperature range, and also the RCP. Y also has the effects of adjusting the melting point of the alloy, increasing the mechanical strength, and the like. When d is above 0.04, the magnetic entropy change ($-\Delta S_M$) is small, or the full width at half maximum of the curve of the magnetic entropy change ($-\Delta S_M$) as a function of temperature under 0-2 Tesla is narrow.

Represented by e is the content of element Z, and is $0 \le e \le 0.04$. Z is capable of inhibiting α-Fe precipitation, controlling the Curie temperature, and improving powder durability. However, with e out of the predetermined range, a compound phase containing a desired amount of the $NaZn_{13}$-type crystal structure phase cannot be obtained, resulting in a small magnetic entropy change ($-\Delta S_M$). When e is above 0.04, the magnetic entropy change ($-\Delta S_M$) is small, or the full width at half maximum of the curve of the magnetic entropy change ($-\Delta S_M$) as a function of temperature under 0-2 Tesla is narrow.

Represented by 1-a-b-c-d-e is the content of Fe and is preferably $0.75 \le 1-a-b-c-d-e \le 0.95$. Fe affects the generation efficiency of the compound phase containing the $NaZn_{13}$-type crystal structure phase.

The alloy represented by the above formula may contain trace amounts of oxygen, nitrogen, and inevitable impurities in the raw materials, though smaller amounts are better.

The method for producing the magnetic refrigeration material of the present invention is not particularly limited, and may be a conventional method, for example, metal mold casting, arc melting, rapid cooling on a roll, or atomizing. In metal mold casting or arc melting, the method for producing the material starts with providing a raw material blended at a predetermined composition. Then the blended raw material is heated to melt in an inert gas atmosphere into a melt, which is poured into a water-cooled copper mold, cooled, and solidified into an ingot.

On the other hand, in rapid cooling on a roll or atomizing, the raw material is heated to melt in the same way as mentioned above to obtain an alloy melt at a temperature of not less than 100° C. higher than the melting point, and then the alloy melt is poured onto a water-cooled copper roll, rapidly cooled, and solidified into alloy flakes.

The alloy obtained by cooling and solidification may be subjected to heat treatment for homogenization. The heat treatment, if adopted, may preferably be carried out in an inert gas atmosphere at not lower than 600° C. and not higher than 1250° C. The duration of the heat treatment is usually not shorter than 10 minutes and not longer than 100 hours, preferably not shorter than 10 minutes and not longer than 30 hours.

Heat treatment at a temperature above 1250° C. evaporates the rare earth components on the alloy surface to cause shortage of these components, which may result in decomposition of the compound phase containing the $NaZn_{13}$-type crystal structure phase. On the other hand, heat treatment at a temperature lower than 600° C. may result in that the ratio of the compound phase containing the $NaZn_{13}$-type crystal structure phase falls short of a predetermined amount, the α-Fe phase ratio in the alloy is increased, and the magnetic entropy change ($-\Delta S_M$) is decreased.

The heat-treated alloy is in the form of ingots, flakes, or spheres, having a particle size with a mean particle diameter of 0.1 μm to 2.0 mm. The alloy may be subjected to pulverization as required. The resulting powder as it is or processed into a sintered body, may be used as a magnetic refrigeration material.

The particle size may be achieved by pulverization with mechanical means, such as jaw crusher, disk mill, attritor, and jet mill. Grinding in a mortar or the like may also be possible, and these means are not limiting. The pulverization may optionally be followed by sieving for obtaining powder of a desired particle size.

A sintered body may be prepared, for example, in vacuum or an inert gas atmosphere at not lower than 1000° C. and not higher than 1350° C. for not shorter than 10 minutes and not longer than 50 hours.

In the present invention, the magnetic entropy change ($-\Delta S_M$) and its full width at half maximum are determined by SQUID magnetometer (trade name MPMS-7, manufactured by QUANTUM DESIGN). The magnetic entropy change ($-\Delta S_M$) may be determined by the Maxwell relation shown below from a magnetization-temperature curve obtained by determination of magnetization under an applied magnetic field of constant intensity up to 2 Tesla over a particular temperature range:

$$\Delta S_M = \int_0^H \left(\frac{dM}{dT}\right)_H dH$$

wherein M is magnetization, T is a temperature, and H is an applied magnetic field.

From the product of the maximum ($-\Delta S_{max}$) of the magnetic entropy change ($-\Delta S_M$) thus obtained and the full width at half maximum, the RCP representing the magnetic refrigeration performance may be calculated by the following formula:

$$RCP = -\Delta S_{max} \times \delta T$$

wherein $-\Delta S_{max}$ is the maximum of $-\Delta S_M$ and δT is the full width at half maximum of the peak of $-\Delta S_M$.

The magnetic refrigeration material according to the present invention has a Curie temperature, at which temperature the magnetic entropy change ($-\Delta S_M$) is maximum ($-\Delta S_{max}$), higher than the magnetic refrigeration materials of the conventional $NaZn_{13}$-type $La(FeSi)_{13}$ compound.

The magnetic refrigeration material according to the present invention may be used over a temperature range as wide as from 220 K to 276 K or from 220 K to 250 K. Further, the full width at half maximum of the curve of the magnetic entropy change ($-\Delta S_M$) as a function of temperature under 0-2 Tesla is wide. Thus less kinds of materials are required than conventionally were for constituting a magnetic refrigeration system.

The maximum ($-\Delta S_{max}$) of the magnetic entropy change ($-\Delta S_M$) (J/kgK) of the magnetic refrigeration material of the present invention when subjected to a field change up to 2 Tesla is not less than 5 J/kgK, preferably 5 to 7.1 J/kgK. When the maximum ($-\Delta S_{max}$) of the magnetic entropy change ($-\Delta S_M$) is less than 5 J/kgK, the magnetic refrigeration performance is not sufficient, resulting in low magnetic refrigeration efficiency.

The full width at half maximum (K) of the curve of the magnetic entropy change ($-\Delta S_M$) of the magnetic refrigeration material of the present invention as a function of temperature under 0-2 Tesla is not less than 40 K. With a full width at half maximum of not less than 40 K, a wide operating temperature range is achieved. In contrast, with a full width at half maximum of not more than 40 K, the operating temperature range is narrow, and handling of the material is inconvenient, thus not being preferred.

The RCP (J/kg) representing the magnetic refrigeration performance of the magnetic refrigeration material of the present invention when subjected to a field change up to 2 Tesla is not lower than 200 J/kg, preferably 200 to 362 J/kg. With a low RCP, the refrigeration performance of the magnetic refrigeration material may not be sufficient.

The magnetic refrigeration device, and further the magnetic refrigeration system according to the present invention utilize the magnetic refrigeration material of the present invention. The magnetic refrigeration material of the present invention may be processed into various forms before use, for example, mechanically processed strips, powder, or sintered powder. The magnetic refrigeration device and the magnetic refrigeration system are not particularly limited by their kinds. For example, the device and the system may preferably have a magnetic bed in which the magnetic refrigeration material of the present invention is placed, an inlet duct for a heat exchange medium arranged at one end of the magnetic bed and an outlet duct for the heat exchange medium arranged at the other end of the magnetic bed so that the heat exchange medium passes over the surface of the magnetic refrigeration material, permanent magnets arranged near the magnetic bed, and a drive system changing the relative positions of the permanent magnets with respect to the magnet refrigeration material of the present invention to apply/remove the magnetic field.

Such preferred magnetic refrigeration device and magnetic refrigeration system function in such a way that, for example, the relative positions of the permanent magnets with respect to the magnetic bed are changed by operating the drive system, so that the state where the magnetic field is applied to the magnetic refrigeration material of the present invention is switched to the state where the magnetic field is removed from the magnetic refrigeration material, upon which entropy is transferred from the crystal lattice to the electron spin to increase entropy of the electron spin system. By this means, the temperature of the magnetic refrigeration material of the present invention is lowered, which is transferred to the heat exchange medium to lower the temperature of the heat exchange medium. The heat exchange medium, of which temperature has thus been lowered, is discharged from the magnetic bed through the outlet duct to supply the refrigerant to an external cold reservoir.

EXAMPLES

The present invention will now be explained with reference to Examples and Comparative Examples, which do not intend to limit the present invention.

Example 1

Raw materials were measured out at a composition shown in Table 1, and melted into an alloy melt in an argon gas atmosphere in a high frequency induction furnace. The alloy melt was poured into a copper mold to obtain an alloy of 10 mm thick. The obtained alloy was heat treated in an argon gas atmosphere at 1150° C. for 20 hours, and ground in a mortar. The ground powder was sieved to collect the powder obtained through 18-mesh to 30-mesh sieves, to obtain alloy powder. The alloy powder was subjected to determination of the magnetic entropy change ($-\Delta S_M$), and based on its maximum ($-\Delta S_{max}$) and the full width at half maximum of the curve of the magnetic entropy change ($-\Delta S_M$) of the alloy powder as a function of temperature under 0-2 Tesla, RCP was evaluated by the method discussed above. The results are shown in Table 2.

Examples 2 to 9 and Comparative Examples 1 to 7

A magnetic refrigeration material was prepared in the same way as in Example 1 except that the composition was changed as shown in Table 1. The obtained alloy powder of the magnetic refrigeration material was evaluated in the same way as in Example 1. The results are shown in Table 2.

TABLE 1

| | |
|---|---|
| Example 1 | $La(Fe_{0.83}Si_{0.12}Co_{0.01}Ga_{0.04})_{13}$ |
| Example 2 | $La(Fe_{0.83}Si_{0.12}Co_{0.01}Al_{0.04})_{13}$ |
| Example 3 | $La(Fe_{0.83}Si_{0.12}Co_{0.01}Ga_{0.02}Al_{0.02})_{13}$ |
| Example 4 | $La(Fe_{0.83}Si_{0.10}Co_{0.02}Ga_{0.05})_{13}$ |
| Example 5 | $La(Fe_{0.815}Si_{0.14}Co_{0.015}Al_{0.03})_{13}$ |
| Example 6 | $La_{0.85}Nd_{0.15}(Fe_{0.83}Si_{0.12}Co_{0.01}Ga_{0.04})_{13}$ |
| Example 7 | $La_{0.90}Pr_{0.10}(Fe_{0.79}Si_{0.13}Co_{0.02}Ga_{0.04}B_{0.02})_{13}$ |
| Example 8 | $La(Fe_{0.805}Si_{0.11}Co_{0.01}Ga_{0.025}Al_{0.025}C_{0.015}Cr_{0.01})_{13}$ |
| Example 9 | $La_{0.80}Ce_{0.20}(Fe_{0.80}Si_{0.12}Co_{0.01}Al_{0.06}Zr_{0.01})_{13}$ |
| Comp. Ex. 1 | $La(Fe_{0.87}Si_{0.12}Ga_{0.01})_{13}$ |
| Comp. Ex. 2 | $La(Fe_{0.86}Si_{0.12}Al_{0.02})_{13}$ |
| Comp. Ex. 3 | $La(Fe_{0.80}Si_{0.12}Ga_{0.08})_{13}$ |
| Comp. Ex. 4 | $La(Fe_{0.80}Si_{0.12}Al_{0.08})_{13}$ |
| Comp. Ex. 5 | $La(Fe_{0.86}Si_{0.07}Co_{0.07})_{13}$ |
| Comp. Ex. 6 | $La(Fe_{0.82}Si_{0.10}Co_{0.07}Ga_{0.01})_{13}$ |
| Comp. Ex. 7 | $La(Fe_{0.77}Si_{0.12}Co_{0.08}Al_{0.03})_{13}$ |

TABLE 2

| | Curie temperature (K) | Maximum magnetic entropy change ($-\Delta S_{max}$) (J/kgK) | Relative Cooling Power RCP (J/kg) |
|---|---|---|---|
| Example 1 | 268 | 6.8 | 320 |
| Example 2 | 254 | 5.3 | 270 |
| Example 3 | 260 | 5.9 | 289 |
| Example 4 | 276 | 7.1 | 362 |
| Example 5 | 255 | 5.8 | 301 |
| Example 6 | 259 | 6.9 | 310 |
| Example 7 | 253 | 6.1 | 268 |
| Example 8 | 273 | 5.8 | 290 |
| Example 9 | 255 | 5.3 | 272 |
| Comp. Ex. 1 | 215 | 8.9 | 151 |
| Comp. Ex. 2 | 215 | 4.9 | 157 |
| Comp. Ex. 3 | 271 | 2.3 | 115 |
| Comp. Ex. 4 | 259 | 2.7 | 162 |
| Comp. Ex. 5 | 280 | 6.2 | 186 |
| Comp. Ex. 6 | 283 | 6.5 | 163 |
| Comp. Ex. 7 | 295 | 5.8 | 159 |

What is claimed is:

1. A magnetic refrigeration material of a composition represented by the formula $La_{1-f}RE_f(Fe_{1-a-b-c-d-e}Si_aCo_bX_cY_dZ_e)_{13}$, wherein RE stands for at least one element selected from the group consisting of rare earth elements including Sc and Y and excluding La, X stands for at least one of Ga and Al, Y stands for at least one element selected from the group consisting of Ge, Sn, B, and C, Z stands for at least one element selected from the group consisting of Ti, V, Cr, Mn, Ni, Cu, Zn, and Zr, a satisfies $0.03 \le a \le 0.17$, b satisfies $0.003 \le b \le 0.02$, c satisfies $0.02 \le c \le 0.10$, d satisfies $0 \le d \le 0.04$, e satisfies $0 \le e \le 0.04$, and f satisfies $0 \le f \le 0.50$, wherein said magnetic refrigeration material has a Curie temperature of not lower than 220 K and not higher than 276 K, and a maximum ($-\Delta S_{max}$) of magnetic entropy change ($-\Delta S_M$) of said material when subjected to a field change up to 2 Tesla is not less than 5 J/kgK.

2. The magnetic refrigeration material according to claim 1, wherein a full width at half maximum (K) of a curve of the magnetic entropy change ($-\Delta S_M$) as a function of temperature under 0-2 Tesla is not less than 40 K.

3. The magnetic refrigeration material according to claim 1, wherein said material has a relative cooling power representing magnetic refrigeration performance when the material is subjected to a field change up to 2 Tesla, of not less than 200 J/kg.

4. The magnetic refrigeration material according to claim 1, wherein said material has a Curie temperature of not lower than 220 K and not higher than 250 K.

5. A magnetic refrigeration device utilizing the magnetic refrigeration material of claim 1.

6. The magnetic refrigeration material according to claim 2, wherein said material has a relative cooling power representing magnetic refrigeration performance when the material is subjected to a field change up to 2 Tesla, of not less than 200 J/kg.

7. The magnetic refrigeration material according to claim 3, wherein said material has a Curie temperature of not lower than 220 K and not higher than 250 K.

8. A magnetic refrigeration device utilizing the magnetic refrigeration material of claim 2.

9. A magnetic refrigeration device utilizing the magnetic refrigeration material of claim 3.

10. A magnetic refrigeration device utilizing the magnetic refrigeration material of claim 4.

* * * * *